US005650211A

United States Patent [19]

Randolph

[11] Patent Number: 5,650,211

[45] Date of Patent: Jul. 22, 1997

[54] QUILT DESIGN PLANNER

[76] Inventor: Minabess P. Randolph, 20 Pine Tree Rd., Toms River, N.J. 08753

[21] Appl. No.: 551,416

[22] Filed: Nov. 1, 1995

[51] Int. Cl.[6] ..... B32B 9/00

[52] U.S. Cl. ..... 428/57; 428/35.2; 428/102; 428/195; 428/21; 428/321.3; 428/327; 428/906.6; 428/131; 156/63; 156/93; 156/250; 156/265; 112/402; 106/32.5; 106/31.09

[58] Field of Search ..... 428/57, 102, 195, 428/221, 225, 224, 288, 321.3, 327, 906.6, 131; 112/266.1, 420, 402; 156/63, 93, 250, 265; 106/23, 32.5

[56] References Cited

U.S. PATENT DOCUMENTS

| | | | |
|---|---|---|---|
| Re. 25,031 | 8/1961 | Hoolim | 35/27 |
| D. 311,873 | 11/1990 | Arend | D10/71 |
| 1,087,207 | 2/1914 | Austin . | |
| 2,511,953 | 6/1950 | Tallman | 35/24 |
| 4,082,875 | 4/1978 | Citron | 428/134 |
| 4,386,980 | 6/1983 | Fitzpatrick et al. | 156/63 |
| 4,646,666 | 3/1987 | Burrier | 112/266.1 |
| 4,814,218 | 3/1989 | Shane | 428/102 |
| 4,940,628 | 7/1990 | Lin et al. | 428/207 |
| 5,099,773 | 3/1992 | Codos | 112/266.1 |
| 5,110,295 | 5/1992 | Concra | 434/88 |
| 5,191,716 | 3/1993 | Anderson | 33/483 |
| 5,207,581 | 5/1993 | Boyd | 434/412 |

*Primary Examiner*—Patrick Ryan
*Assistant Examiner*—Abraham Bahta
*Attorney, Agent, or Firm*—Jacobson, Price, Holman & Stern, PLLC

[57] ABSTRACT

A quilt design planner in the form of relatively thin but substantially rigid panels or strips having a grid marking on an upwardly exposed surface thereof positioned in overlying relation to the sashings and/or borders on the quilt top to enable a quilter to more effectively plan the design to be formed on the sashings and/or borders prior to making any marks on the quilt top. The panels or strips having the grid marking thereon have an easily erasable surface on which designs may be formed by using templates or stencils and a marking pencil or other marker. This enables a quilter to form, lay out and adjust the design on the panels or strips with the planned design overlying the sashing and/or borders around each block of the quilt top.

5 Claims, 1 Drawing Sheet

QUILT DESIGN PLANNER

BACKGROUND OF THE INVENTION

1. Field of the Invention

The present invention generally relates to a quilt design planner in the form of relatively thin but substantially rigid panels or strips having a grid marking on an upwardly exposed surface thereof positioned in overlying relation to the sashings and/or borders on the quilt top to enable a quilter to more effectively plan the design to be formed on the sashings and/or borders prior to making any marks on the quilt top. The panels or strips having the grid marking thereon have an easily erasable surface on which designs may be formed by using templates or stencils and a marking pencil or other marker to form, lay out and adjust the design on the panels or strips with the planned design overlying the sashing and/or borders around each block of the quilt top.

2. Description of the Prior Art

Before quilting a quilt top, the design to be formed on the sashings or borders is conventionally marked directly onto the sashings or borders by the use of a marker and stencils, templates or by freehand. Many times quilters, when marking designs on the sashings or borders by the use of markers, the quilter discovers that the desired design does not fit properly on the border or may not work out properly at the corners of the quilt top block design which necessitates additional design markings being placed on the quilt top.

Efforts have been made to provide devices to assist quilters in quilting the quilt top and various devices have been provided with erasable surfaces. The following U.S. Pat. Nos. are relevant to this field of endeavor.

| | |
|---|---|
| 1,087,207 | 5,191,716 |
| 2,511,953 | 5,207,581 |
| 4,082,875 | Re. 25,031 |
| 4,940,628 | Des. 311,873 |
| 5,110,295 | |

The above listed patents do not disclose a planner for use by quilters in the form of a panel or plurality of panels having a grid layout inscribed on the upper surface which is erasable to enable the strips to be placed in concentric relation to a block design on the quilt top in overlying relation to the sashings and borders to enable a design to be marked directly on the planner and erased, if necessary, in order to adjust the physical characteristics of the design to the physical characteristics of the quilt top sashings or borders. The planned design is then transferred from the planner to the quilt top by the use of the same stencil and a marking pencil or other marker by marking the design directly onto the quilt border or sashing thereby eliminating multiple markings on the quilt top which have often been required when using previously known quilting aids when trying to adjust the design to the dimensions of the sashings and/or borders.

SUMMARY OF THE INVENTION

An object of the invention is to provide a quilt design planner in the form of a grid board, panel or strip having an erasable surface provided with permanent grid markings to enable the planner to be placed on a quilt top in overlying relation to the sashings or borders thereby enabling a quilter to use an erasable pen or marker to mark off the dimensions of the border or sashing and to form a sashing or border design directly on the erasable surface of the planner by the use of a stencil, template or by free hand drawing.

Another object of the invention is to provide a quilt design planner in accordance with the preceding object in which the erasable surface and erasable marker enables the design placed on the grid board or strip to be erased or wiped off and the design adjusted until it satisfies the quilter and properly fits within the dimensions of the sashing or border with the erasable surface enabling the design to be wiped off by the use of a damp cloth or the like and the design redrawn until the adjusted design is satisfactorily related to the sashing or border.

A further object of the invention is to provide a quilt design planner which can be oriented around a corner of a block design on the quilt top or completely enclosing a block design with an adjusted design formed on the planner being transferred directly to the quilt top by the use of the same stencil or template used in adjusting the design thereby avoiding multiple markings on the sashings or borders which can occur when trying to adjust a design by making multiple markings directly on the quilt top.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 3:
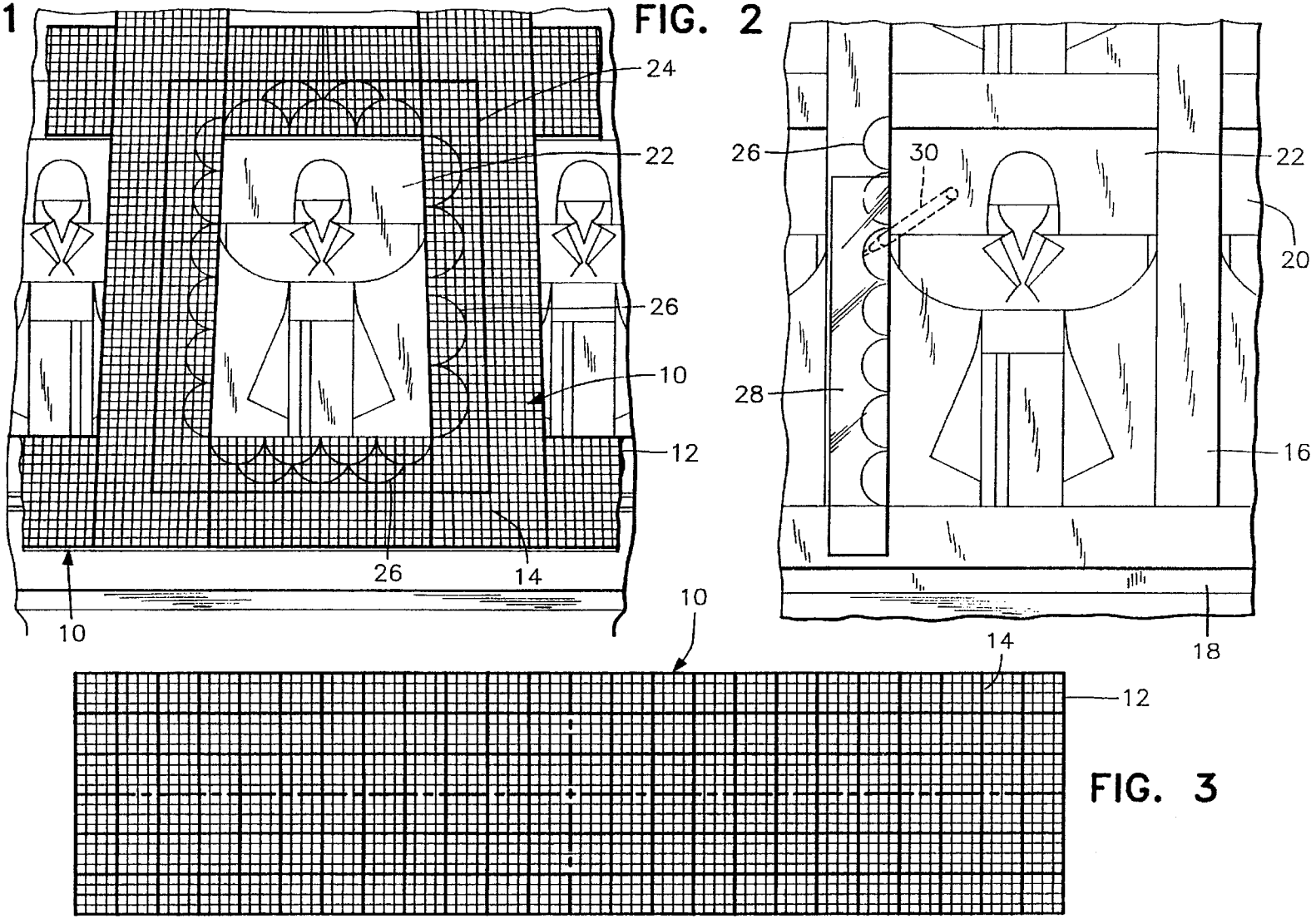
FIG. 1 is a plan view of a quilt top with quilt design planners of this invention oriented in overlying relation to the sashings and border of a block design in the quilt top with an adjusted design formed on the planners.
FIG. 2 is a top plan view similar to FIG. 1 but illustrating the use of a template to transfer the adjusted design from the planner to the sashing alongside a block design on a quilt top.
FIG. 3 is a top plan view of the grid board of this invention with an erasable top surface with a permanent grid marking.

Referring now specifically to the drawings, the quilt design planner of the present invention is illustrated in FIG. 3 and designated by reference numeral 10 with FIG. 1 illustrating the manner in which the planner 10 is used. The planner 10 includes an elongated grid board 12 of rectangular construction and generally in the form of a strip or panel constructed of heavy cardboard, plastic, hardboard or the like with the upper surface having an erasable finish formed thereon and provided with a permanent grid 14 marked thereon. The grid may be formed of lines which are equally spaced and of equal prominence or certain of the equally spaced lines may be heavier to facilitate comparison of a design to be marked on the erasable surface by using an erasable pen or other erasable marking implement. The grid markings 14 are distinguishable from the remainder of the surface with the grid markings being black or dark and the remainder of the surface being white comparable to the color of the sashings 16 or border 18 of a quilt top 20 having a plurality of block designs 22 formed therein.

As is well known, when forming a quilt top, the sashings and borders are not always the same length or width. When this condition exists and conventional stencils or templates are used to mark a design on the sashing or border, the design incorporated into the stencil or template may not be compatible with the physical dimensions of the sashing or border. For examples, the design incorporated into the stencil or template may have length and width dimensional characteristics that do not fit the dimensional characteristics of the sashing which frequently results in making multiple markings directly onto the sashing in order to properly adjust the design to fit the sashing or to look right on the sashing or be properly oriented with respect to the corners of a block design. When multiple markings are made on the sashing or border, it is difficult to follow the final design marking when working the design into the sashing or border and the multiple markings are objectionable since they are difficult to remove from the sashings or borders.

When the planner 10 of the present invention is used, the strip or panel 12 is placed alongside the block design 22 or a plurality of planners 10 may be placed in completely enclosing relation to a block design 22 as illustrated in FIG. 1 which also indicates the indeterminate length of the planner 10. Where the multiple planners 10 intersect, they may be taped in position while being used to plan a design. As illustrated in FIG. 1, a heavy line 24 is made on the planner 10 to indicate the peripheral edges of the sashings or borders with the inner edge of the planners 10 corresponding with the juncture between the edge of the block design and the edge of the sashing or border. Thus, the planner 10 can be oriented along a single side of the block design, around a corner of the block design or in completely encircling relation to the block design with the grid marking 14 providing a guide for marking a design 26 on the planner 10.

The design 26 is drawn directly on the planner 10 by using an erasable pen or other marker and by using a stencil, template or by free hand. The grid markings 14 and the perimeter marking 24 helps to plan and adjust the placement of the design 26. As illustrated in FIG. 1, the width and length dimensions enclosed by the perimeter line 24 enables designs 26 having different characteristics to be drawn onto the planner 10. As illustrated, the design 26 includes different diameter semicircular areas either in a single row or multiple rows. If the design 26 has dimensional characteristics that cannot properly relate to the length and width of the sashings or borders, the design can be merely wiped off the planner and a new design placed thereon that can be adjusted or adapted to the particular dimensional characteristics of the sashings or borders as defined by the perimeter 24. The design 26 can be easily erased if it is not suitable or does not satisfy the quilter. The erasable surface and the design thereon can be wiped off with a damp cloth, paper towel or the like and dried with a dry cloth or paper towel. When the design 26 has been properly adjusted and satisfies the quilter, the design 26 is transferred to the sashing 16 or border 18, as illustrated in FIG. 2, by utilizing the same stencil or template 28 and a marker 30 with the stencil or template 28 being the same as that used in forming the design 26 on the planner 10.

The planner 10 may be utilized along only one side of the block design 22 or two planners can be taped together in perpendicular relation to form a corner to enable the design to extend around the corner in a satisfactory manner and the design then can be transferred to the quilt top. Two or more planners can be taped together in longitudinal relation to extend throughout the length of the border of the quilt top and four planners can be taped together to extend around the periphery of the block design as illustrated in FIG. 1.

By using the planner of this invention, a quilter can plan the design and avoid making mistakes and avoid placing unwanted marks on the quilt top. The erasable surface and erasable mark can be easily wiped off with a damp cloth or paper towel and then wiped dry with a dry cloth or paper towel. The planner can be constructed of various configurations and dimensions with the grid spaces being ⅛ inch or ¼ inch. The planners may have a width of 6 inches and may have a length up to and including 40 inches which would enable four grid strips or planners 10 to be used to conform to the size of a full size quilt. The specific design formed on the planner and subsequently transferred to the sashings or borders can take various shapes and configurations such as semicircular or partial circles, geometric figures of various types, simulated flowers, fruits and the like. The use of the planner greatly reduces the time required in forming a desired design pattern on the sashings and/or borders of a quilt top thereby enabling the quilter to quickly adjust a design to the dimensional characteristics of the sashings or borders and to place the grid markings on the sashings or borders of the quilt toping.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A quilt design planner for positioning in overlying relation to borders of a quilt top with one edge of the planner coinciding with an edge of a block design in the quilt top, said planner including a substantially planar upper surface, permanent grid lines formed on said planner, said planner having an erasable surface on which a border design may be placed with an erasable marking implement to enable a quilter to draw a desired design on the erasable surface, wipe the design out if necessary and adjust it to the dimensional characteristics of the borders to obtain a final desired design on the planner which is applied to the borders of the quilt top from the planner with a single application of markings corresponding to the final design on the planner.

2. The quilt design planner as defined in claim 1 wherein said panel is substantially rigid and generally rectangular in configuration and associated with other panels in right angular relations to enable the panels to encircle a block design to enable designs to be marked directly on said planners and adjusted to the dimensional characteristics of the borders.

3. The quilt design planner as defined in claim 2 wherein the grid lines on the panel are approximately ¼ inch apart, said panel having a width up to 6 inches and a length up to 48 inches.

4. A planner for laying out a design for transfer to a quilt top comprising a substantially rigid panel having a generally planar, erasable top surface positioned in overlying registry with the surface of a quilt top on which a design is to be formed, said top surface of the panel including equally spaced, intersecting grid lines with certain of said grid lines defining the surface area of the quilt top on which a design is to be formed, said grid lines forming guides to enable a design to be marked on said erasable top surface and adjusted to optimum relation to the grid lines defining the surface area corresponding to the surface area of the quilt top on which a design is to be formed, said erasable surface enabling the design markings to be wiped off and replaced until the design is in optimum relation to said certain of said grid lines and the surface area of the quilt top underlying the planner on which the design is to be formed and enabling the adjusted design on the planner to be transferred to the quilt top by a single marking.

5. The method of laying out a design on borders of a quilt top without application of multiple design markings on the borders by a marking implement in order to obtain a desired design consisting of the steps of placing a panel having an erasable top surface and regularly spaced intersecting grid lines in overlying relation to a surface area on the borders of a quilt top on which a design is to be formed, marking a design on the erasable top surface of the panel, erasing and replacing the design on the erasable surface until the final design on the top surface of the panel conforms with the design desired on the surface area of the borders on the quilt top which the design is to be formed, removing the panel and using the design markings on the panel to indicate the orientation of design markings on the surface area of the quilt top, and marking a design on the borders corresponding to the final design markings on the top surface of the panel thereby enabling the desired final design to be placed on the borders of the quilt top with only a single application of markings to the quilt top.

* * * * *